US006307136B1

(12) United States Patent
Sikra et al.

(10) Patent No.: US 6,307,136 B1
(45) Date of Patent: Oct. 23, 2001

(54) PERCUSSION INSTRUMENT ACTUATOR ASSEMBLY

(75) Inventors: Richard A. Sikra, Palmdale; Donald G. Lombardi, Thousand Oaks, both of CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 09/493,294

(22) Filed: Jan. 28, 2000

(51) Int. Cl.[7] ..... G10D 13/02
(52) U.S. Cl. ..... 84/422.1; 84/422.2; 84/422.3
(58) Field of Search ..... 84/422.1, 422.2, 84/422.5

(56) References Cited

U.S. PATENT DOCUMENTS 2,845,830 * 8/1958 Haviland ..... 84/422.1
3,747,464 7/1973 Russell ..... 84/422.1
4,324,164 * 4/1982 Monte et al. ..... 84/744
5,789,688 * 8/1998 Schiano ..... 84/422.1
5,990,401 * 11/1999 Braun et al. ..... 84/422.1

* cited by examiner

*Primary Examiner*—Shih-Yung Hsieh
(74) *Attorney, Agent, or Firm*—William W. Haefliger

(57) ABSTRACT

In a percussion instrument actuating assembly, the combination comprising a carrier structure; first and second pedals carried to extend in generally side-by-side relation and to independently pivot; first rotary axle structure operatively connected to the first pedal to be rotated thereby, and having rotary motion output locations spaced apart along the axle structure and via which rotary motion is transmissible to actuate different percussion instruments in response to selected pivoting of the first pedal; and a second axle structure operatively connected to the second pedal to transmit motion for actuating an additional percussion instrument, in response to selected pivoting of the second pedal.

29 Claims, 7 Drawing Sheets

23
20c
20
20b
76
4
26
25
27
17b
20a
30
17
14a
16
40
28
3
3
17a
21'
134
14bb
135
15
14
21a
14b
21
17c
84
17'
76a
29
18
77
19
29a
130
13a'
18a
13
19a
121
12
132
120
124
11
10
4

60
61
61a
14bb
17c
21
12
28
14b
32
30
42
9
9
17'
29
41
36
40
14a
14
16
11
17
17b
76
14a
26
15
17a
13
134

13
11
120
126
116
18
124
13a
20b
14'
134
135
130
17a
76
26
17
100
77
18
116
126
120
124
13
11

23
20c
20b
20
76
26
20a
21a'
17
14a
160
134
135
21'
60
18
77
29
19
130
18a
13
19a
121
12
120
124
11

PERCUSSION INSTRUMENT ACTUATOR ASSEMBLY

BACKGROUND OF THE INVENTION

This invention relates generally to accurately and controlled selective actuation of different percussion instruments, as by a drummer's foot; and more particularly concerns improvements in drive apparatus to realize these objectives.

There is frequent need for drummer's foot operation of different percussion instruments, as by means of pedal operation. What is needed is a simple, effective and reliable drive system that is pedal operated, and which enables single foot driven accurate operation of multiple pedals, forcefully to selectively actuate different instruments such as drums, cymbals, and cowbells, and other percussion instruments. No prior system of which we are aware incorporates the multiple advantages in construction, operation and results which are now provided by the present invention.

SUMMARY OF THE INVENTION

It is a major object of the invention to provide an improved percussion instrument actuating assembly meeting the above needs. Basically, the assembly comprises, in combination a) carrier structure, b) first and second pedals carried to extend in generally side-by-side relation and to independently pivot, c) first rotary axle structure operatively connected to the first pedal to be rotated thereby, and having rotary motion output locations spaced apart along the axle structure and via which rotary motion is transmissible to actuate different percussion instruments in response to selected pivoting of the first pedal, and d) a second axle structure operatively connected to the second pedal to transmit motion for actuating an additional percussion instrument, in response to selected pivoting of the second pedal.

Accordingly, the user can quickly shift his single foot position to select which of the two pedals is to be foot-pivoted, whereby a quick selection as to operation of different percussion instruments can be made. Also, pivot integrity of each pedal, about a single axis, is maintained.

It is another object to provide first rotary axle structure that extends generally horizontally above the levels of the two pedals, and second axle structure that extends generally vertically to project above the level of the first rotary axle structure. In this regard, a guide tubing carried by the carrier may be provided, and within which the second axle structure extends, and including cymbals elements carried by the tubing and the second axle structure to clash in response to pivoting of the second pedal. Two support legs for the assembly may be carried by the tubing, and in such manner that a base plate typically supports the two pedals to independently pivot, the base plate also being separately pivotally connected to a tubing support frame so that the base plate can be folded upwardly with the pedals, for assembly storage and transport.

A further object is to provide for connection or connecting of a mallet, or mallets, to the first rotary axle structure at an intermediate and/or end location or locations on that axle structure. A percussion instrument support may be provided on the frame, and located in offset relation to the upright tubing and to the first axle structure, whereby a percussion instrument such as a cowbell may be carried and presented for impact by one such mallet.

Yet another object is to provide primary and secondary sections of the first axle structure, to be supported for independent rotation, a first mallet being connected to, or connectible to, one of said sections, the other of the sections being rotatable to transmit motion to actuate a different percussion instrument, via another of the rotary motion output locations.

In this regard, an auxiliary carrier may be provided as at a remote location, together with an auxiliary axle carried by the auxiliary carrier, to be rotated by said other section of the first rotary axle structure, the second mallet carried by the auxiliary axle, for rotation.

An additional object is to provide a clutch that is shiftable to transmit rotary motion to one or the other of said sections, in response to pivoting of the first pedal. That clutch may advantageously have a through opening to receive one or the other of said sections, as selected, and having a peripheral portion coupled to said one pedal, to be rotated thereby, allowing for quick-shifting of the clutch by the user, for selecting which of the percussion instruments is to be actuated or struck. A drive chain may then be operatively coupled between one of the two pedals and the peripheral portion of the clutch.

These and other objects and advantages of the invention, as well as the details of an illustrative embodiment, will be more fully understood from the following specification and drawings, in which:

DRAWING DESCRIPTION

DETAILED DESCRIPTION

Figure 1:
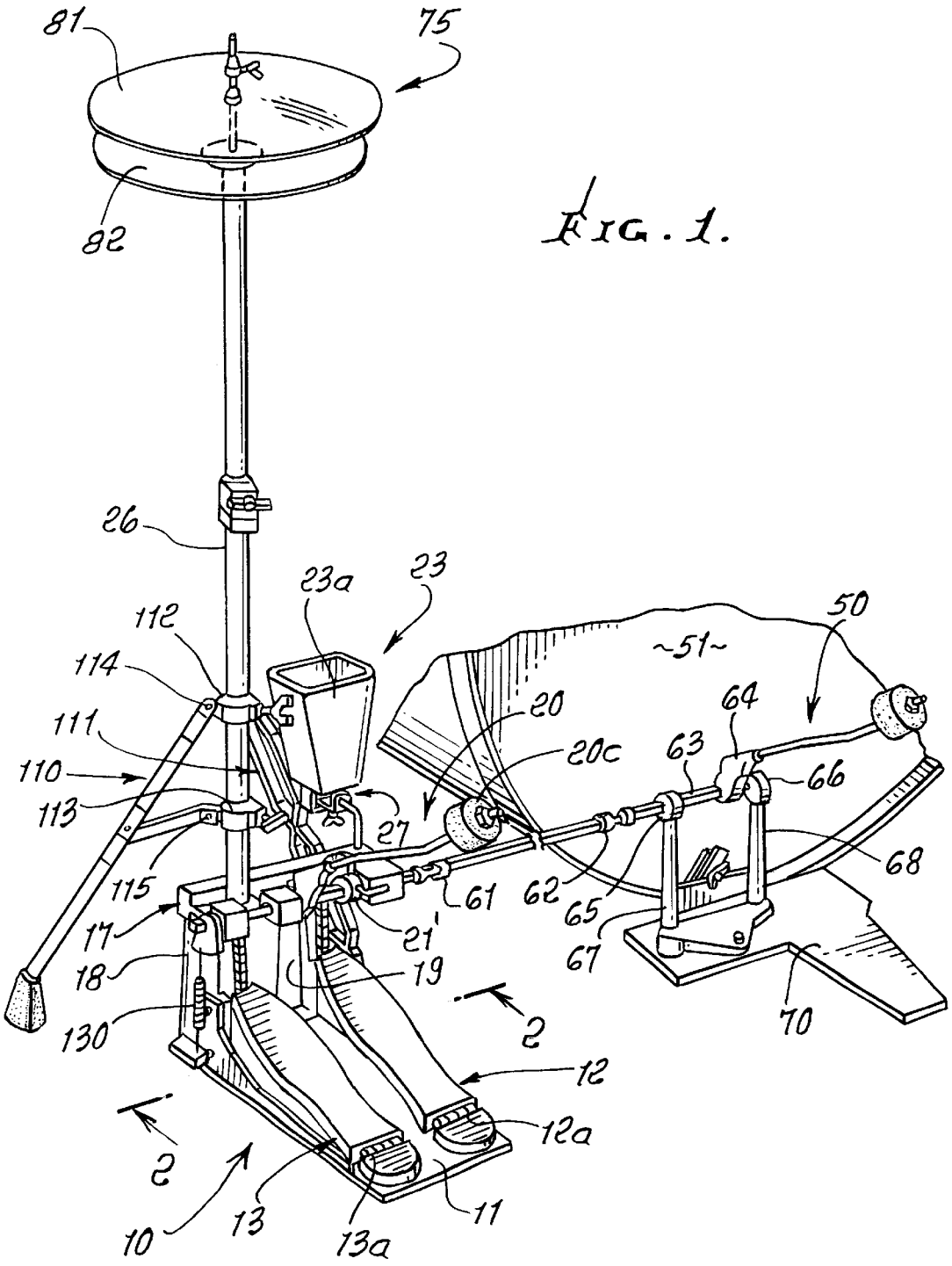
FIG. 1 is a perspective view of one form of the actuator assembly, which is preferred.
Figure 2:
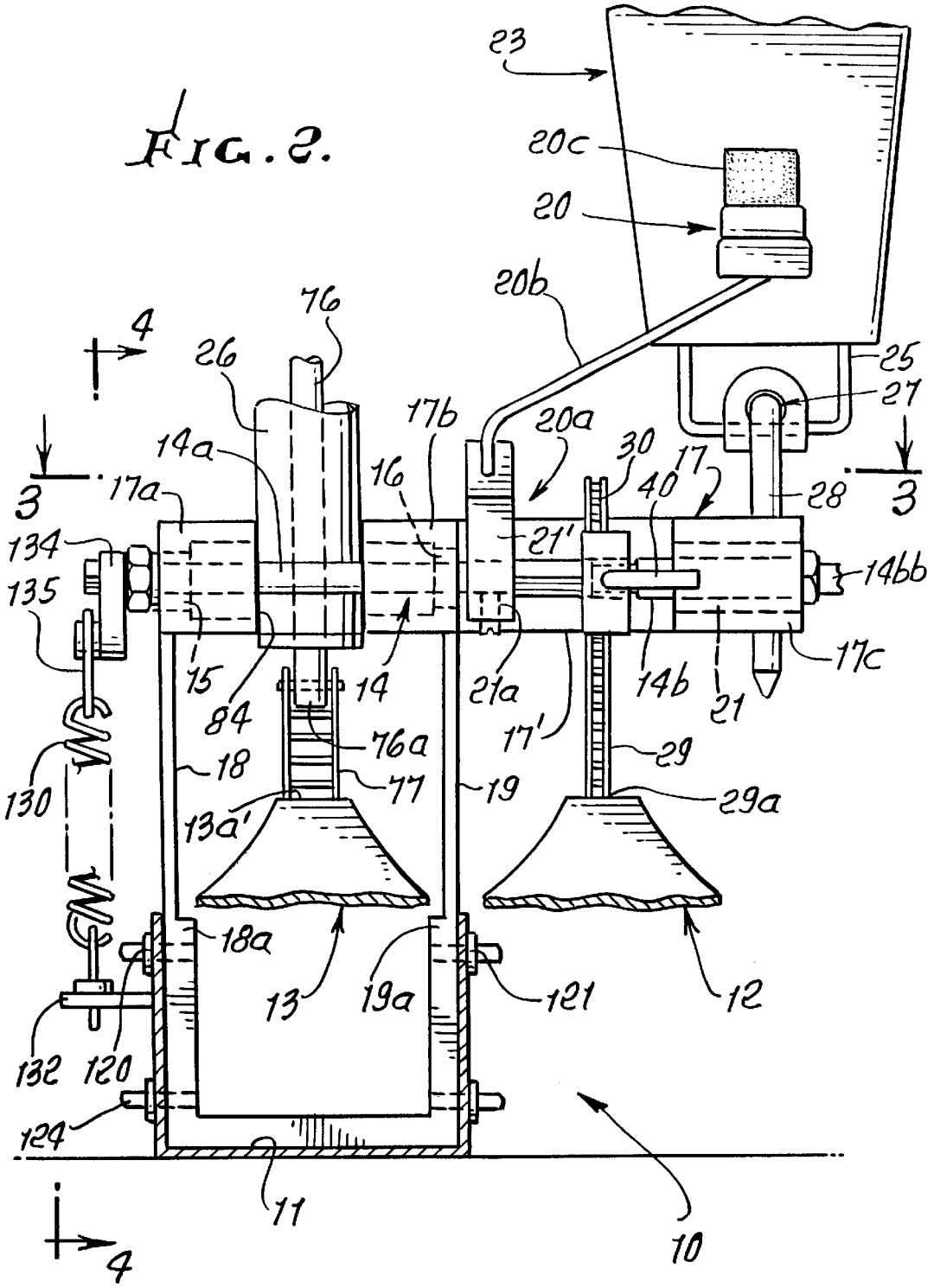
FIG. 2 is an enlarged frontal elevation, taken on lines 2—2 of FIG. 1.

In FIGS. 1 and 2, a carrier structure 10 is shown to include a generally horizontal base plate 11 on which first and second pedals 12 and 13 are carried to extend forwardly and upwardly in side-by-side relation. The pedals have pivoted support at their rearward ends, as indicated at 12*a* and 13*a*. Such support is preferably provided by a roller bearing or bearings, as for example is disclosed in my U.S. Pat. No. 5,627,332, incorporated herein by reference. The two pedals pivot independently, whereby the drummer's foot or shoe can operate either pedal, independently.

In accordance with the invention, first rotary axle structure is operatively connected to the first pedal to be rotated thereby, and having rotary motion output locations spaced apart along the axle structure and via which rotary motion is transmissible to actuate different percussion instruments in response to selected pivoting of the first pedal; and in addition, a second axle structure in operatively connected to the second pedal to transmit motion for actuating an additional percussion instrument, in response to selected pivoting of the second pedal.

Figure 3:
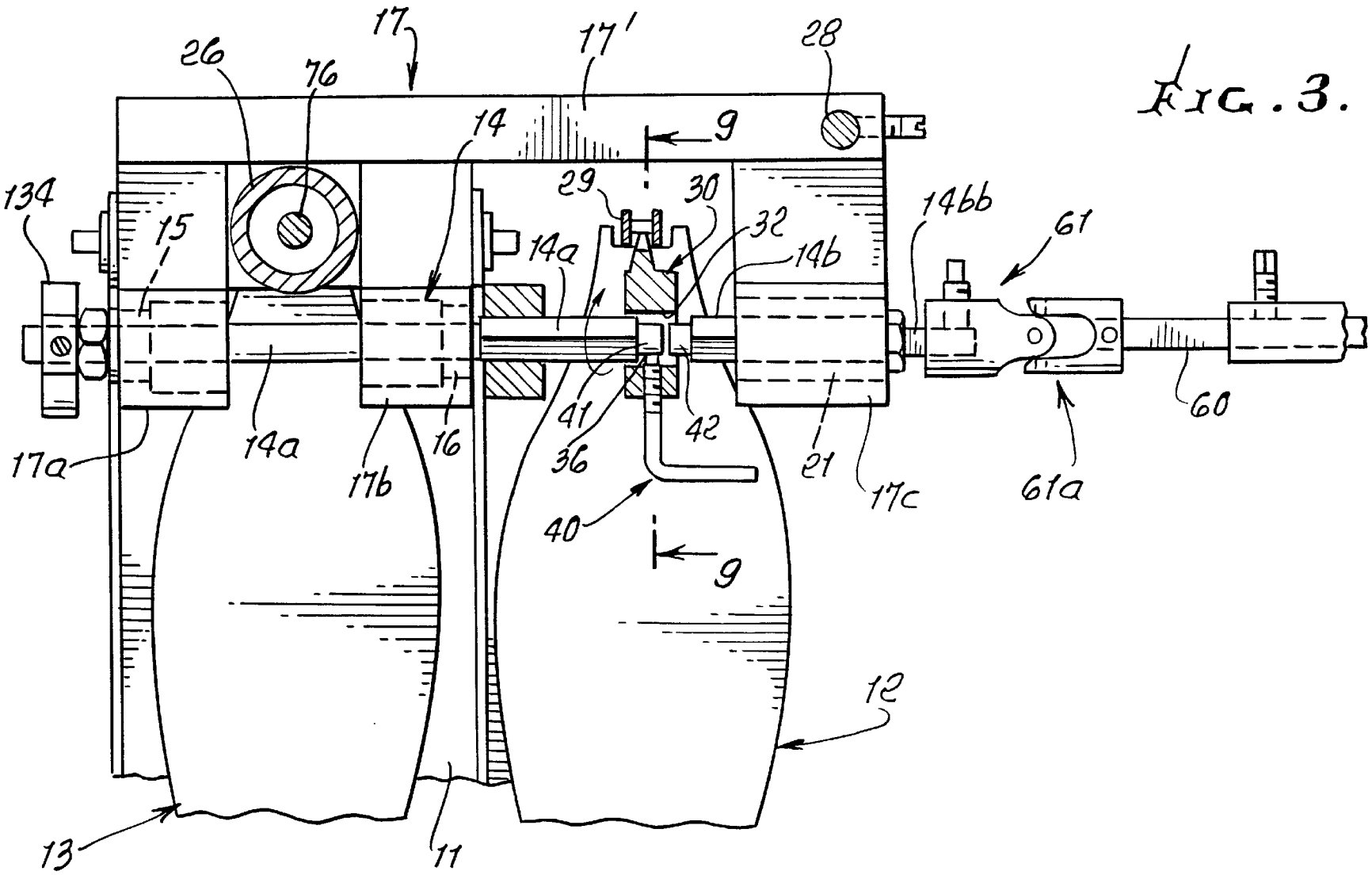
FIG. 3 is a plan view, taken in section on lines 3—3 of FIG. 2, and showing clutch drive of a first shaft.

In the example, as shown as in FIGS. 1, 2, and 3, first or primary axle structure is indicated generally at 14, and includes a first section 14*a* supported at horizontally spaced bearings 15 and 16. The latter are carried by a frame 17 supported by upright pedestals 18 and 19 respectively carried by the base plate. A second section 14*b* of the first axle structure extends endwise of and coaxially with 14*a*. A bearing 21, spaced from bearings 15 and 16, supports section 14*b* of the axle structure 14 for rotation, independently of 14*a*. Bearing 21 is carried by a horizontal extension 17' of frame 17. Frame lug sections 17*a*, 17*b* and 17*c* carry the bearings 15, 16, and 21, those lug sections being longitudinally spaced apart, in the axial direction of the axle structure 14, and attached to longitudinally extending frame member 17'.

A mallet or drum beater 20 is operatively connected to the first axle structure as at a motion output location 20*a*. The beater may include an arm 20*b* to which a beater head 20*c* is attached. The opposite end of the arm is shown as connected to a rotor 21' attached at 21*a* to the axle section 14*a*. See FIG. 2. Arm 20*b* extends diagonally away from a vertical tube 26, so as to position the beater head 20*c* to strike a percussion instrument 23 in response to rotation of the shaft section 20*a*, effected by down pivoting of the first pedal 12. Instrument 23 may for example comprise a cow bell shell indicated at 23*a*, carried by the frame 17, to open upwardly, offset from vertical tubing 26. FIGS. 1 and 2 show a support 25 under the shell 23*a* lower end, and removably attached at 27 to a strut 28 supported by and projecting upwardly from the frame 17. A drive chain 29 is connected at one end 29*a* to the forward end of pedal 12, and at the chain upper end to a rotor in the form of a sprocket 30. That sprocket is shown in FIG. 2 as selectively operatively connected to the axle section 14*a*, to rotate it as the pedal 12 moves downwardly.

Figure 6:
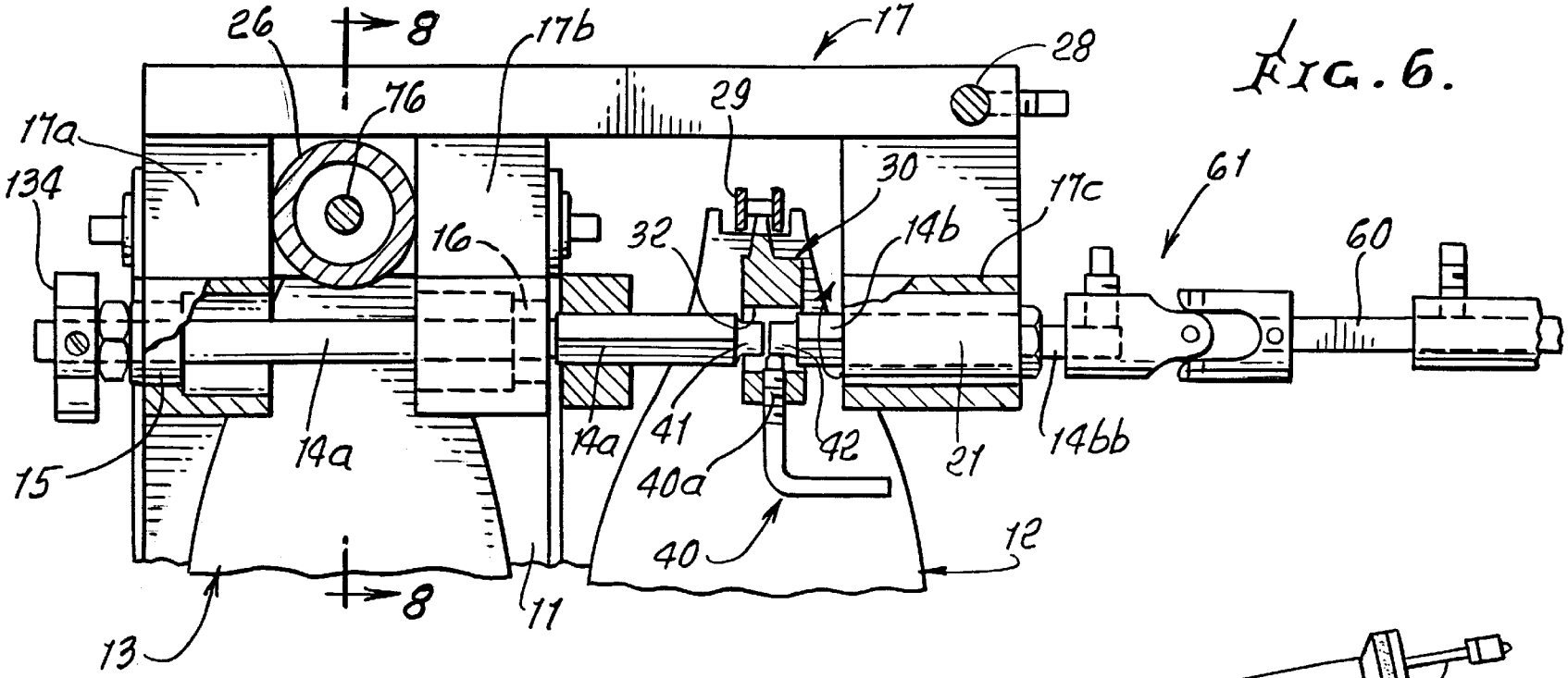
FIG. 6 is a view like FIG. 3, but showing a shifted position of a clutch to drive a second shaft.
Figure 9:
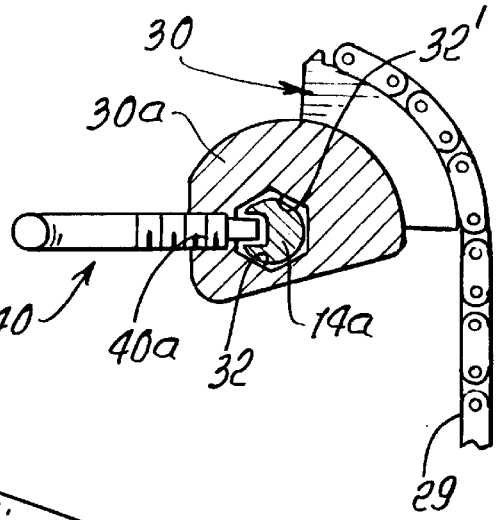
FIG. 9 is an enlarged fragmentary section taken on lines 9—9 of FIG. 3, to show chain drive of the clutch that in turn drives a selected shaft.

In accordance with an important aspect of the invention, a clutch is provided and is shiftable to transmit rotary motion to the other axle section 14*b*, in response to downward pivoting of the pedal 12. Rotor or sprocket 30 provides such a clutch, as by means of an axially extending through opening 32 (see FIG. 9) through the rotor hub 30*a*, and operable to receive one or the other of the axle sections 14*a* and 14*b*, according to which axial direction the rotor is shifted. FIGS. 2 and 3 show the sprocket in leftward shifted position, coupled at 36 to axle section 14*a*, as via cooperative shoulders or lands 32' on the axle section and/or at the rotor opening 32. FIG. 6 shows the rotor and clutch shifted axially to the right, to de-couple from 14*a*, and to couple to 14*b*, as via shoulders or lands. A key 40 threaded at 40*a* to the rotor hub, is turnable to lock to a projection 41 from section 14*a*, or to a projection 42 from section 14*b*, to hold the rotor in selected shifted position. Therefore, operation of pedal 12 serves to rotate axle section 14*a*, and mallet 20, or to rotate axle section 14*b*, and operate remote mallet 50, that strikes a remote percussion instrument such as a drum 51, to be described. Chain 29 is sufficiently flexible for axial movement of its upper end at and with sprocket 30, as the sprocket rotor is shifted axiall, as described.

The second or secondary section 14*b* of the axle structure in effect provides a second rotary motion output location, as for example at the protruding end 14*bb* of the section 14*b*. See FIG. 3. The second mallet 50 is operatively connected to axle section end 14*bb*, as via an elongated extension or intermediate shaft 60 that can be coupled at 61 to end 14*bb*, as shown. A universal joint connection is shown at 61*a*. The opposite end of shaft 60 is coupled at universal joint 62 to rotary axle 63 to which mallet 50 is connected, at 64. Axle 63 is supported for rotation at bearings 65 and 66 carried by upright pedestals 67 and 68, the lower ends of which are supported by an adjustable position auxiliary base plate 70, as shown. Accordingly, pedal 12 may be operated to cause selective beating of drum 51, or beating of the cow bell 23.

Figure 8:
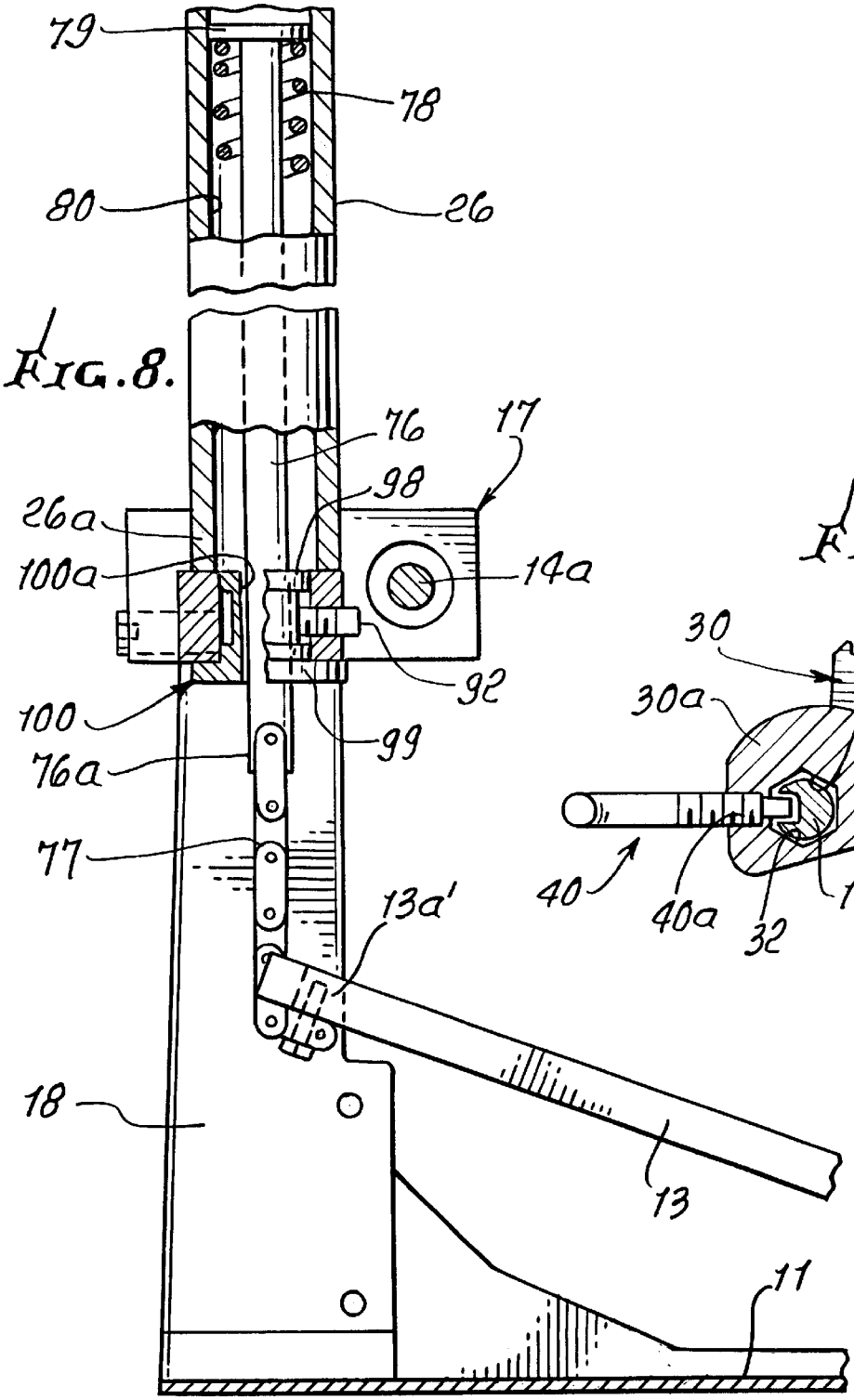
FIG. 8 is a vertical elevation taken through tubing to illustrate movement of a cymbal drive shaft.

Referring to FIGS. 1, 2 and 8 second pedal 13 is operatively connected to a second axle structure, to actuate an additional percussion instrument, such as cymbals 75. The illustrated second axle structure 76 is shown as extending vertically in sidewardly offset relation to above first section 14*a* of the first axle structure. A chain 77 is connected between the forward end 13*a'* of pedal 13, and the lower end 76*a* of vertical axle or rod 76, to lower the latter as the pedal is pushed downwardly. A compression spring may be employed to urge the axle 76 upwardly, as after its downward displacement. See in FIG. 8 the spring 78 positioned beneath a flange 79 on the axle, and guided vertically by the bore 80 of protective tubing 26; the tubing protecting the axle as it moves up and down to displace cymbals upper disc 81 up and down. Tubing 26 also supports the cymbals lower disc 82, to be struck or clashed by the upper disc. The lower end 26*a* of the tubing is supported at 84 by the frame 17, between lugs 17*a* and 17*b*, as shown in FIGS. 2 and 3. FIG. 8 shows a locating pin 92 having sideward threaded connection with tubing 26, and extending between vertically spaced flanges 98 and 99 on a bearing 100, thereby locating the bearing in the lower end of the tubing. Bearing 100 has a bore 100*a* for guiding vertical movement of the axle rod 76. Accordingly, the cymbals discs are positioned to clash in response to pivoting of the second pedal 13.

Figures 4, 5:
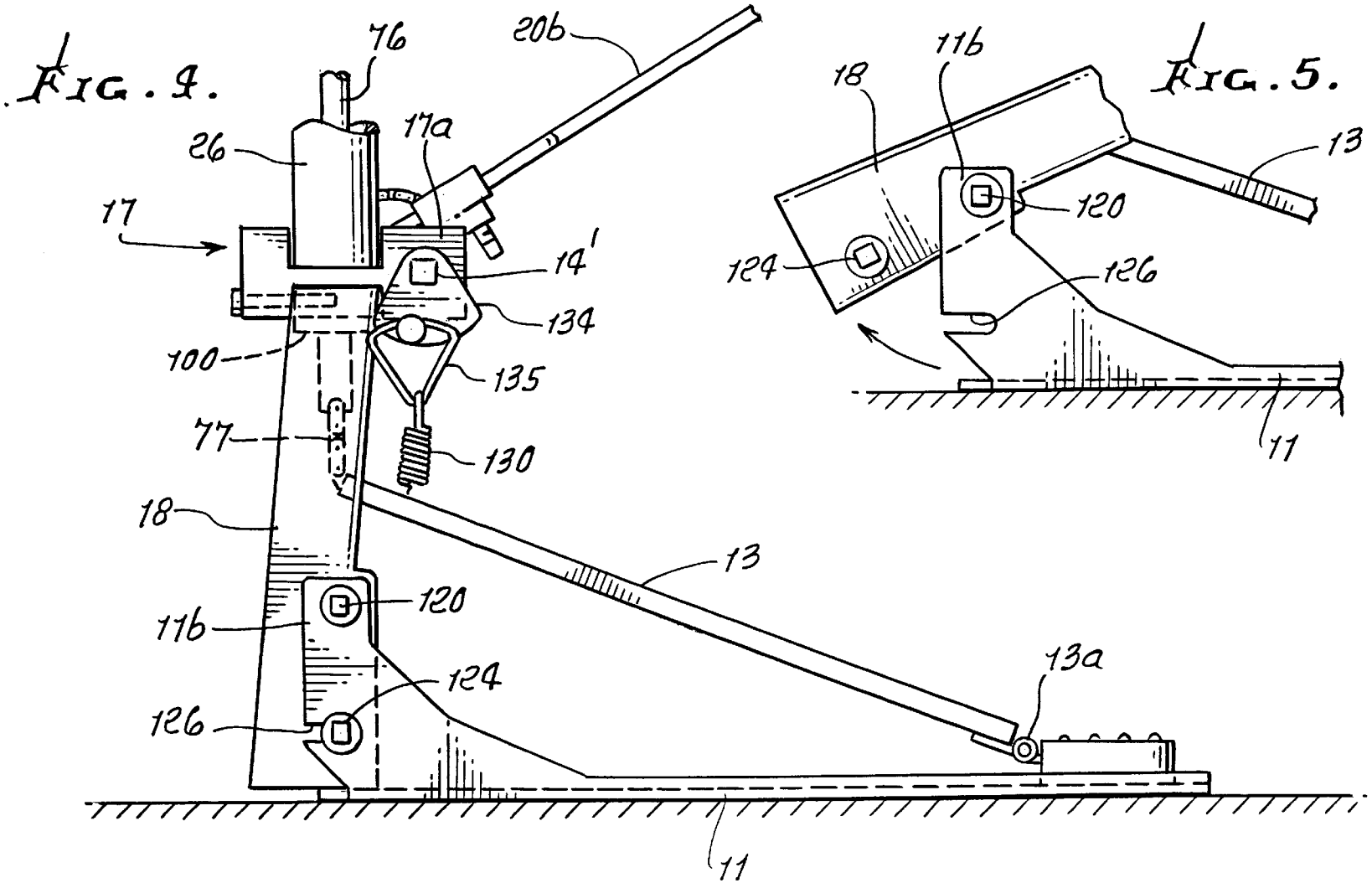
FIG. 4 is a side elevation taken on lines 4—4 of FIG. 2.
FIG. 5 is a fragmentary side elevation showing a pivoting mode of the apparatus, as for storage.
Figure 7:
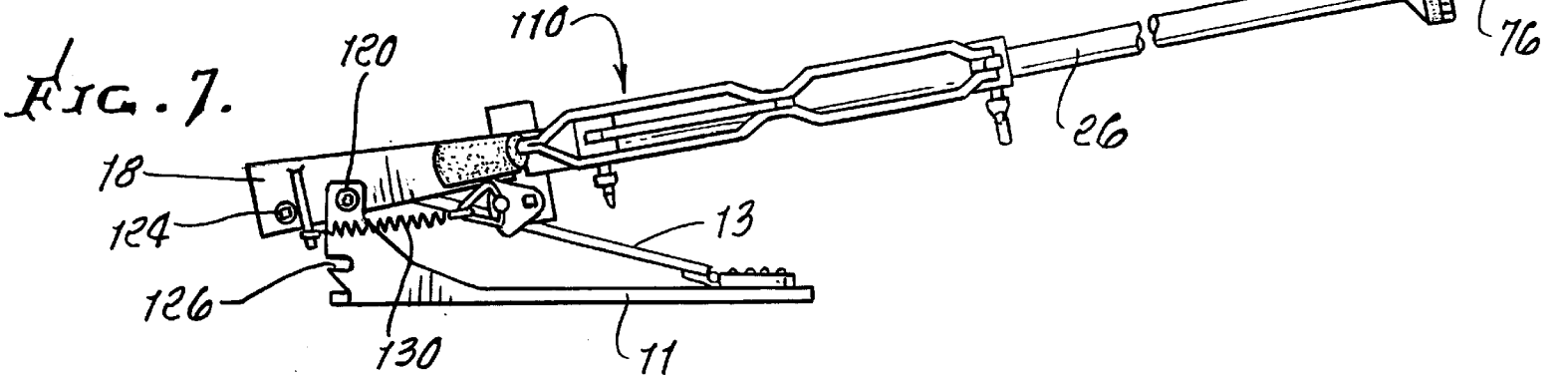
FIG. 7 is a side elevation showing completion of folding, for storage or transport of the apparatus.
Figure 10:
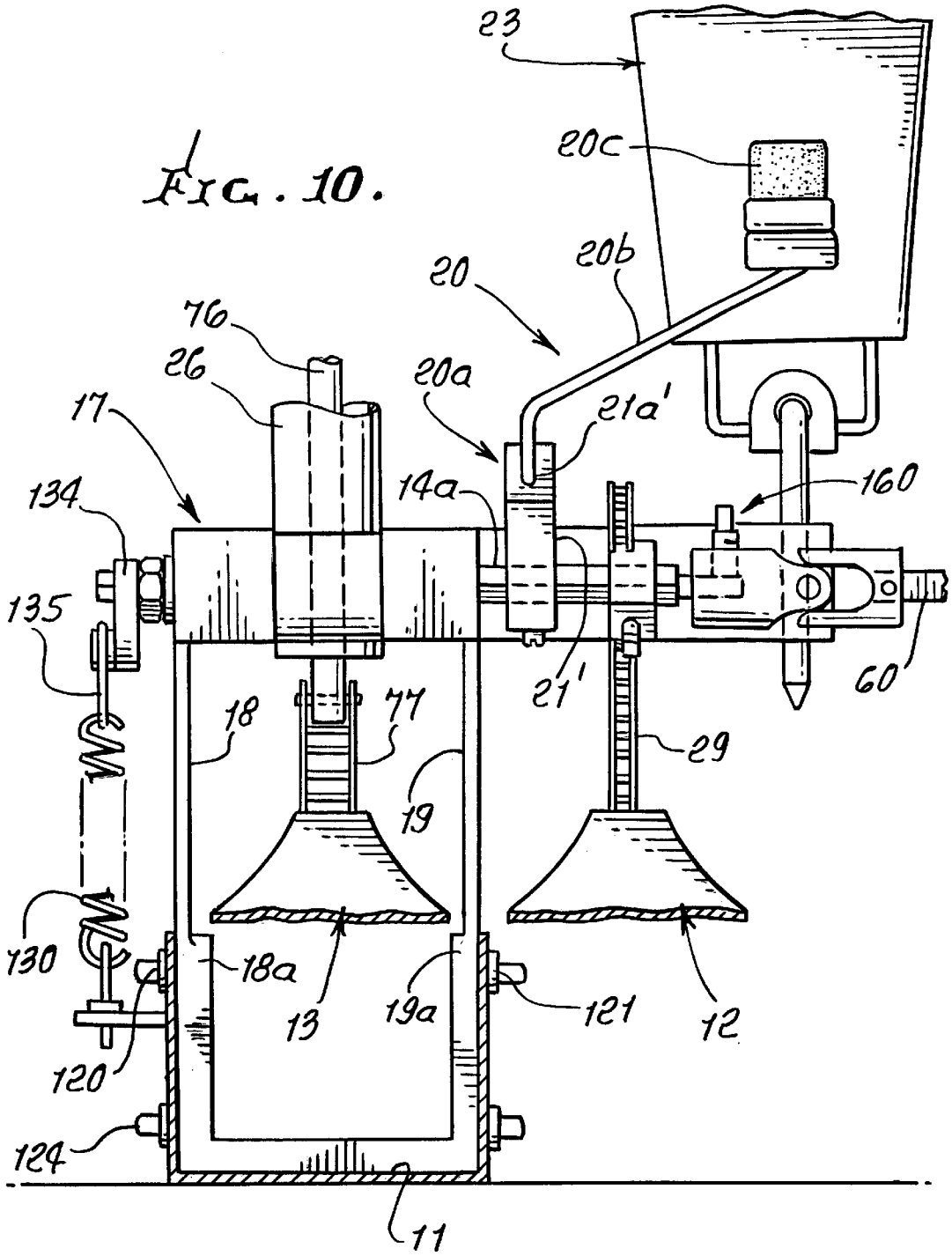
FIG. 10 is a view like FIG. 2, but showing a modified form of the apparatus.

A further feature is the provision of two support legs 110 and 111 pivotally carried by tubing 26. Note collars 112 and 113 extending about and coupled to the tubing, and pivotally connected at 114 and 115 to the support legs. This allows extension of the legs for vertically stabilized support of the apparatus as in FIG. 1 position, or collapse of the legs for transport, as shown in FIG. 7, with the legs extending alongside the tubing 26. This is further facilitated by pivotal connection at 120 and 121 of the base plate 11 to the lower end portions 18*a* and 19*a* of the pedestals 18 and 19, as shown in FIGS. 4, 7 and 10. When the pedestals or tubing 76 extend upright, a projection 124 or projections, on the pedestal 18 lower end portion is received in guide slot 126 defined by the base plate upright section 11*b*.

Finally, a tension spring 130 is provided to rotatably urge the first axle section 14*a* in restoring rotary direction, tending to elevate the forward end of the pedal 12. The lower end of the spring is connected as at 132 to the lower portion of upright 18; and the spring upper end is connected as via a loop 135 (see FIG. 4) to an over-center or eccentric lever 134 coupled to the end 14*a'* of axle section 14*a*, proximate upright 18, as best seen in FIGS. 4 and 10. Apparatus as seen in FIGS. 1–9 is preferred.

The modified apparatus shown in FIG. 10 is like that of FIGS. 1–9, and bears corresponding identifying numerals, with the exception of the following: axle section 14*b* is deleted, and axle section 14*a* is directly end-coupled at 160 to the intermediate or extension shaft 60, in the manner as referred to above. Also, sprocket rotor 30 is not axially shiftable, but has operative connection to axle section 14*a* at only one location, as shown. If only the mallet 20 is to be rotated in response to pivoting of pedal 12, coupling 160 is disconnected. If only the remote mallet 50 (see FIG. 1) is to be rotated, in response to pivoting of pedal 12, the mallet 20 arm 20*b* is disconnected or removed, as by removal from a slot 21*a* in rotor 21'.

We claim:

1. In a percussion instrument actuating assembly, the combination comprising a) carrier structure, b) first and second pedals carried to extend in generally side-by-side relation and to independently pivot, c) first rotary axle structure operatively connected to the first pedal to be rotated thereby, and having at least one rotary motion output location via which rotary motion is transmissible to actuate at least one percussion instrument in response to selected pivoting of the first pedal, and d) a second axle structure operatively connected to the second pedal to transmit motion for actuating an additional percussion instrument, in response to selected pivoting of the second pedal, e) and including a mallet operatively connected to the first rotary axle structure at a motion output location located at an end of said first rotary axle structure.

2. The combination of claim 1 wherein said first rotary axle structure extends generally horizontally above the levels of the two pedals, and said second axle structure extends generally vertically to project above the level of the first rotary axle structure.

3. The combination of claim 2 including a tubing carried by the carrier and within which the second axle structure extends, and including cymbals elements carried by the tubing and the second axle structure to clash in response to pivoting of the second pedal.

4. The combination of claim 3 including at least two support legs pivotally carried by the tubing.

5. The combination of claim 3 wherein the carrier includes frame structure that supports the tubing and that also supports said first rotary axle structure.

6. The combination of claim 4 wherein the carrier includes a base plate on which the two pedals are mounted to independently pivot.

7. The combination of claim 6 which the carrier includes a frame that carries said tubing, the base plate pivotally connected to the frame to be folded upwardly along with the pedals, for assembly storage.

8. The combination of claim 1 including a chain operatively connected between the second pedal and the second axle structure.

9. The combination of claim 1 including a mallet operatively connected to the first rotary axle structure at one of said motion output locations.

10. In a percussion instrument actuating assembly, the combination comprising a) carrier structure, b) first and second pedals carried to extend in generally side-by-side relation and to independently pivot, c) first rotary axle structure operatively connected to the first pedal to be rotated thereby, and having rotary motion output locations spaced apart along the axle structure and via which rotary motion is transmissible to actuate different percussion instruments in response to selected pivoting of the first pedal, and d) a second axle structure operatively connected to the second pedal to transmit motion for actuating an additional percussion instrument, in response to selected pivoting of the second pedal, e) and including a first mallet operatively connected to the first rotary axle structure at one of said motion output locations, and a second mallet operatively connected to the first rotary axle structure at a motion output location located at an end of said first rotary axle structure.

11. In a percussion instrument actuating assembly, the combination comprising a) carrier structure, b) first and second pedals carried to extend in generally side-by-side relation and to independently pivot, c) first rotary axle structure operatively connected to the first pedal to be rotated thereby, and having rotary motion output locations spaced apart along the axle structure and via which rotary motion is transmissible to actuate different percussion instruments in response to selected pivoting of the first pedal, and d) a second axle structure operatively connected to the second pedal to transmit motion for actuating an additional percussion instrument, in response to selected pivoting of the second pedal, e) said first rotary axle structure extending generally horizontally above the levels of the two pedals, and said second axle structure extending generally vertically to project above the level of the first rotary axle structure, f) there being tubing carried by the carrier and within which the second axle structure extends, and including cymbals elements carried by the tubing and the second axle structure to clash in response to pivoting of the second pedal, g) the carrier including frame structure that supports the tubing and that also supports said first rotary axle structure, h) and including a percussion instrument support on said frame structure, and located in offset relation to said tubing and to said first rotary axle structure.

12. The combination of claim 11 including a percussion instrument supported by said support.

13. The combination of claim 12 including a mallet operatively connected to the first rotary axle structure at one of said motion output locations, said mallet located to strike said percussion instrument in response to rotation of the first rotary axle structure effected by pivoting of the first pedal causing motion transmission to the mallet via one of said locations.

14. The combination of claim 13 wherein the first rotary axle structure includes primary and secondary sections that are supported for independent rotation, the first mallet connected to one of said sections, the other of said sections being rotatable to transmit motion to actuate a different percussion instrument, via another of said rotary motion output locations.

15. The combination of claim 14 including a second mallet operatively connected to said other section.

16. The combination of claim 15 including an auxiliary carrier, and an auxiliary axle carried by the auxiliary carrier to be rotated by said other section of the first rotary axle structure, the second mallet carried by the auxiliary axle, for rotation.

17. The combination of claim 15 including a clutch that is shiftable to transmit rotary motion to one or the other of said sections, in response to pivoting of the first pedal.

18. The combination of claim 17 wherein said clutch comprises a rotor having a through opening to receive one or the other of said sections, as selected, and having a peripheral portion coupled to said one pedal, to be rotated thereby.

19. The combination of claim 18 including a drive chain operatively coupled between said one pedal and said peripheral portion of the clutch.

20. Percussion instrument apparatus, comprising in combination a) at least one pedal to be foot driven, b) first and second drives to transfer motion for operating percussion instruments, c) a selectively shiftable coupling driven by the pedal for transmitting pedal movement to either of said first and second drives, d) at least one of said drives including a first rotary axle structure, e) and including a mallet operatively connected to said first axle structure at a motion output location located at an end of said first rotary axle structure.

21. The combination of claim 20 wherein said drives are rotary drives having end portions that are in the paths of shifting of said coupling.

22. The combination of claim 21 wherein said coupling has interfitting engagement with the end portion of one of said drives when the coupling is decoupled from the other of said drives, and wherein the coupling has interfitting engagement with the end portion of the other of said drives when the coupling is decoupled from said one drive.

23. The combination of claim 20 wherein the pedal remains connected to the coupling during said selective shifting thereof.

24. The combination of claim 23 wherein the pedal has a heel portion and a toe portion, and the coupling remains connected to said toe portion.

25. The combination of claim 20 including a second pedal to be foot driven, a common base supporting said two pedals for pivoting, and a third drive to be driven by the second pedal for operating a percussion instrument.

26. The combination of claim 25 including said percussion instruments.

27. The combination of claim 20 including said percussion instruments.

28. The combination of claim 20 including a shifting element projecting to be engaged by the drummer, for shifting said coupling.

29. The combination of claim 20 including a second pedal, said pedals operable to transfer motion to said drives.

* * * * *